US006843431B2

(12) United States Patent
Airaksinen et al.

(10) Patent No.: US 6,843,431 B2
(45) Date of Patent: Jan. 18, 2005

(54) APPARATUS FOR PREVENTING DRYING OF NOZZLE IN FLUID DISPENSING DEVICE

(75) Inventors: Pentti Airaksinen, Oulu (FI); Esko Hietanen, Turku (FI); Jukka Hietanen, Turku (FI)

(73) Assignee: CPS Color Group Oy, Vantaa (FI)

( * ) Notice: Subject to any disclaimer, the term of this patent is extended or adjusted under 35 U.S.C. 154(b) by 0 days.

(21) Appl. No.: 10/363,412

(22) PCT Filed: Aug. 31, 2001

(86) PCT No.: PCT/FI01/00757

§ 371 (c)(1),
(2), (4) Date: Sep. 2, 2003

(87) PCT Pub. No.: WO02/20175

PCT Pub. Date: Mar. 14, 2002

(65) Prior Publication Data

US 2004/0056111 A1 Mar. 25, 2004

(30) Foreign Application Priority Data

Sep. 4, 2000 (FI) ..... 20001940

(51) Int. Cl.[7] ..... B05B 15/02

(52) U.S. Cl. ..... 239/112; 239/104; 239/106

(58) Field of Search ..... 239/104, 106, 239/112

(56) References Cited

U.S. PATENT DOCUMENTS 4,534,494 A * 8/1985 Hautemont ..... 239/112
5,205,305 A * 4/1993 Yamakita ..... 239/112
5,842,641 A 12/1998 Mazzalveri
6,116,518 A * 9/2000 Negrini et al. ..... 239/112

* cited by examiner

*Primary Examiner*—Steven J. Ganey
(74) *Attorney, Agent, or Firm*—Young & Thompson

(57) ABSTRACT

An apparatus for preventing the drying of at least one nozzle of a fluid dispensing device includes an element providing moist gas, a supply hose for moist gas and a gas controller which forms a space around the nozzle. Moist gas is led into the space around the nozzle from the elements providing gas through the supply hose. Moist gas leaking out of the space is replaced by new moist gas led into the space.

7 Claims, 1 Drawing Sheet

APPARATUS FOR PREVENTING DRYING OF NOZZLE IN FLUID DISPENSING DEVICE

BACKGROUND OF THE INVENTION

The invention relates to an apparatus for preventing the drying of one or more nozzles of a fluid dispensing device.

A problem with dispensing devices of fluid, such as colour paste, is that the dispensed fluid dries in the nozzles when the device is not in use. Colour pastes are deliberately made to dry quickly so that they do not slow the drying of the paint. However, dried colour paste in the nozzles dirties the nozzles and causes blockage and dispensing errors in the devices. Attempts have been made to prevent the drying of the agent to be dispensed in the nozzles using different kinds of casings. U.S. Pat. No. 5,842,641 discloses a solution in which a tight casing is put around the nozzles, in which a sponge or a corresponding absorbing material soaked in liquid moisturises the nozzles. A problem with the arrangement described above is the reliability of the sealing. Casings have a tendency to leak, whereby the dispensed agent in the nozzles will inevitably dry in time. Adding liquid into the casing requires continuous maintenance and a complex construction of the device.

BRIEF DESCRIPTION OF THE INVENTION

It is thus an object of the invention to develop an apparatus so as to solve the above-mentioned problems. The object of the invention is achieved by an arrangement which is characterized by what is stated in the independent claim. Preferred embodiments of the invention are disclosed in the dependent claims.

The invention is based on directing moisturised air or other gas to the nozzles. The moisturised gas is directed to the nozzles by a gas controller which restricts the gas to the area surrounding the nozzles, but also allows the gas to flow out when new moist gas replaces it. Because a tight casing is not required, the device is easy to implement and reliable in use. Normal water and an inexpensive aquarium pump can be used to implement the device of the invention, which means that the entire apparatus can be easily and inexpensively built.

BRIEF DESCRIPTION OF THE FIGURES

The invention will now be described in more detail by means of the preferred embodiments, with reference to the attached drawings, in which.

DETAILED DESCRIPTION OF THE INVENTION

Figure 1:
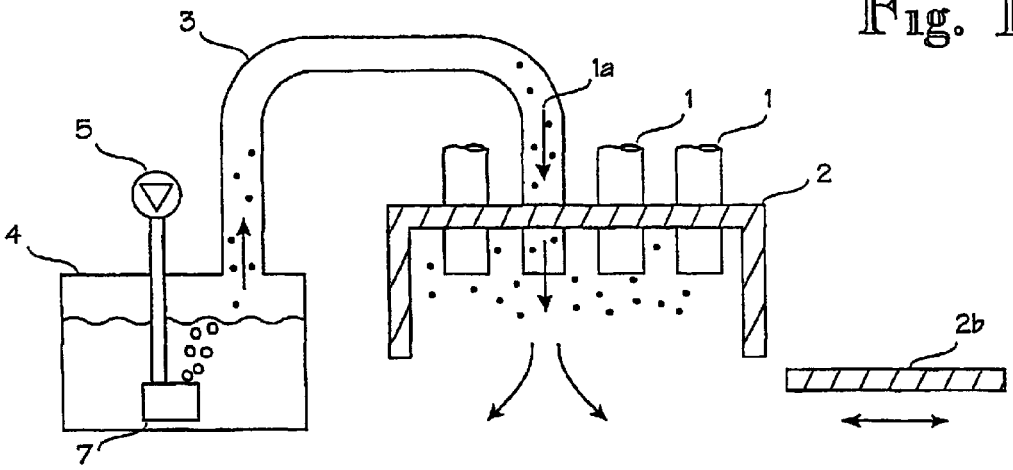
FIG. 1 shows a schematic diagram of a preferred embodiment of an apparatus of the invention.

FIG. 1 shows a preferred embodiment of the invention, in which gas moisturised in an apparatus 4 is led around nozzles 1. Differing from the figure, a dispensing device can have only one nozzle or a nozzle group made up of nozzles. Moist gas is led through a supply hose 3 to the area surrounding the nozzles 1 that is restricted by a gas controller 2. The gas controller 2 is attached to the support structure of the nozzles 1 in such a manner that it forms a restricted but open area for the moist gas around the nozzles. The purpose of the gas controller is to direct the moist gas exiting the supply hose 3 to the proximity of the nozzles so as to prevent the colour paste from drying in the nozzles. Directing the gas can be improved by adding a movable plate 2*b* to the gas controller to form a bottom wall for the gas controller when moved into place. Even then, the gas controller is not hermetically sealed, but the gas directed into the space is allowed to flow freely out while new moist gas replaces it. The amount and flow of the exiting gas can be controlled by moving the position of the plate 2*b* in relation to the gas controller 2. Instead of a plate-like piece, it is possible to use a cup-like piece, for instance, with an open bottom part as exit for the gas.

The moist gas led to the area surrounding the nozzles is, as shown in the figure, preferably produced by a means 4 comprising a container partly filled with water and a pump 5. Air is pumped into the water in the container by the pump in small bubbles, the air bubbles rise in the container above the surface of the water and thus, moisturised air is obtained to be led through the supply hose 3 to the nozzle 1. The container can be any suitable sealed container with an outlet for the moisturised air above the surface of the water. An air discharge point 7 of the pump 5 is located in the container in such a manner that it is below the surface of the water, preferably close to the bottom of the container. The apparatus can be implemented simply by using an aquarium pump, in which case the pump is outside the container and a discharge tube of the pump is brought down from the top part of the container to the water. The easiest and most inexpensive way is to use water in the container, but other liquids moisturising air are also possible, if the properties of the dispensed agent allow it. The air pumped in to the container can also be some other gas than normal breathing air. Instead of a pump, it is possible to use an alternative gas source, such as a bellows or, when conditions allow it, a gas bottle from which pressurised air or other gas is slowly discharged into the liquid.

The dispensing device can have one or more nozzles or a nozzle group formed by nozzles. When there are several nozzles, one nozzle 1*a* of the nozzle group and a conduit attached to it should preferably be used as the supply hose 3. Said nozzle 1*a* and its conduit then only serves as a supplier of moist air and does not supply the dispensed agent. The supply hose can also be a separate pipe attached beside the nozzle group, for instance.

Figure 2:
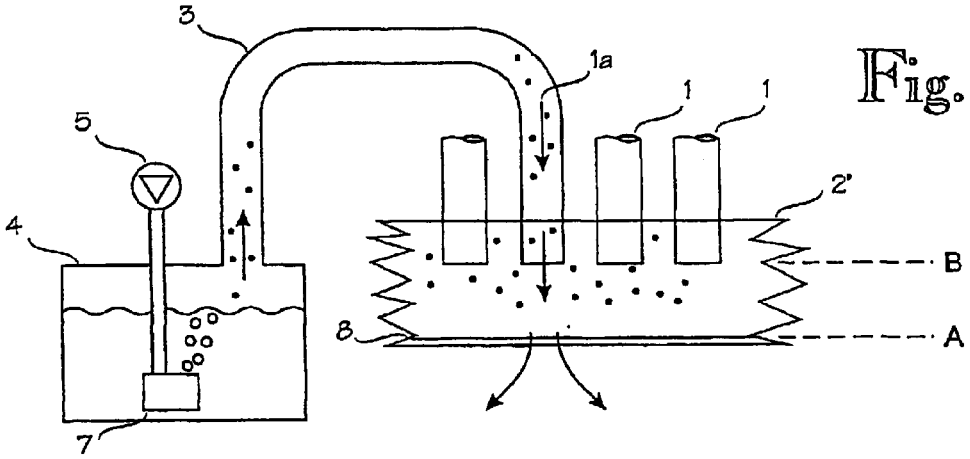
FIG. 2 shows a schematic diagram of a second embodiment of an apparatus of the invention.

FIG. 2 shows a second embodiment of the invention, in which moisturised gas is produced and led as in FIG. 1. In this embodiment, the gas controller 2' is an accordion-like piece placed around the nozzles. The piece is cylindrical and the folding construction of its walls enables the piece to contract and expand in longitudinal direction. The top part of the gas controller 2' is fastened to the nozzle(s) and the bottom part has an adapting element 8 for a paint canister to be filled with the dispensing device. When the dispensing device is in the off-position, the gas controller 2' rests on the fastening in the nozzles 1 and is thus in its expanded position A providing an as big a space around the nozzles 1 as possible.

Figure 3:
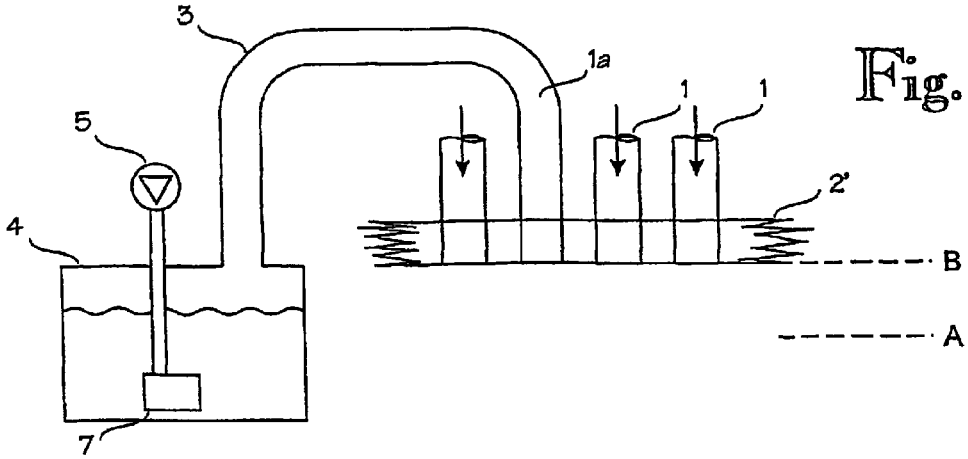
FIG. 3 shows the embodiment of FIG. 2 when the apparatus is in off-position.

FIG. 3 shows the embodiment of FIG. 2 when the dispensing device is in use and the paint canister (not shown in the figure) fastened to the device pushes the gas controller 2' to its contracted position B, in which case the space formed by the gas controller is non-existent and does not prevent the dispensing of the colour paste. Alternatively, it is possible to use instead of the accordion-like piece a sleeve as the gas controller, which sleeve goes up and down by effect of the paint canister depending on the operating mode of the dispensing device as shown in FIGS. 2 and 3.

It is obvious to a person skilled in the art that the basic idea of the invention can be implemented in many different ways. The invention and its embodiments are thus not restricted to the examples described above, but can vary within the scope of the claims.

What is claimed is:

1. An apparatus for preventing the drying of one or more nozzles of a fluid dispensing device, the apparatus comprising a means providing moist gas, a supply hose for moist gas and a gas controller forming a space around said one or more nozzles, into which space the moist gas is led from the means providing moist gas through the supply hose, wherein the gas controller further comprises a piece movable to partially close the space around said one or more nozzles, the moist gas leaking out being arranged to be replaced by new moist gas led into the space.

2. An apparatus as claimed in claim 1, wherein the piece movable to partially close the space around said one or more nozzles is a plate forming a bottom wall for the gas controller.

3. An apparatus as claimed in claim 1, wherein the gas controller is an accordion-like piece, which is in a contracted position when the dispensing device is in use and during other times, it is in an expanded position.

4. An apparatus as claimed in claim 1, wherein the means providing moist gas comprises a container partly filled with liquid and a gas source, which is arranged to discharge gas into the liquid, and an outlet for the moisturised gas is provided in the container above the level of the liquid.

5. An apparatus as claimed in claim 4, wherein the gas source is an air-pumping pump, bellows or pressurised gas bottle having a gas discharge point preferably located close to the bottom of the container.

6. An apparatus as claimed in claim 5, wherein the pump is an aquarium pump.

7. An apparatus as claimed in claim 1, wherein a nozzle or a conduit attached to it serves as the supply hose.

* * * * *